United States Patent [19]

Tone

[11] Patent Number: 4,856,723

[45] Date of Patent: Aug. 15, 1989

[54] METHOD AND APPARATUS FOR CHANGING BOBBINS IN LOT FOR AN AUTOMATIC WINDER

[75] Inventor: Shoichi Tone, Kyoto, Japan

[73] Assignee: Murata Kikai Kabushiki Kaisha, Kyoto, Japan

[21] Appl. No.: 166,700

[22] Filed: Mar. 11, 1988

Related U.S. Application Data

[63] Continuation-in-part of Ser. No. 165,520, Mar. 8, 1988, abandoned.

[30] Foreign Application Priority Data

Mar. 12, 1987 [JP] Japan ..... 62-57500

[51] Int. Cl.[4] ..... B65H 54/20; B65H 63/00; B65H 67/06

[52] U.S. Cl. ..... 242/35.5 R; 242/35.5 A; 242/35.6 R; 242/36

[58] Field of Search ..... 242/35.5 A, 35.5 R, 242/35.6 R, 36, 39

[56] References Cited

U.S. PATENT DOCUMENTS

| | | | |
|---|---|---|---|
| 3,236,466 | 2/1966 | Yoshida et al. | 242/35.5 R |
| 4,512,526 | 4/1985 | Tone et al. | 242/36 |
| 4,532,759 | 8/1985 | Bischafberger | 242/35.5 R |
| 4,566,644 | 1/1986 | Kiriake | 242/35.5 A |
| 4,576,341 | 3/1986 | Matsui et al. | 242/35.5 A |
| 4,634,066 | 1/1987 | Matsui et al. | 242/35.5 A |

*Primary Examiner*—Stanley N. Gilreath
*Attorney, Agent, or Firm*—Spensley Horn Jubas & Lubitz

[57] ABSTRACT

A method of changing bobbins in lot for an automatic winder comprises the steps of hindering fully wound winding units from further winding yarns when an amount of a residual yarn supply becomes smaller than a predetermined value, and discharging bobbins with residual yarn from the fully wound winding units to deliver the same to the other winding units being in winding operation.

17 Claims, 12 Drawing Sheets

METHOD AND APPARATUS FOR CHANGING BOBBINS IN LOT FOR AN AUTOMATIC WINDER

This application is a continuation-in-part of parent application Ser. No. 07/165,520, filed Mar. 8, 1988, entitled "Method Of Changing Bobbins In Lot for Automatic Winder", now abandoned.

FIELD OF THE INVENTION

The present invention relates to a method and apparatus for changing bobbins in lot for an automatic winder.

RELATED ART STATEMENT

It is known that yarns produced at a spinning frame are first wound on bobbins and then rewound by an automatic winder into a package of a predetermined amount and shape.

The automatic winder of this type has a plurality of winding units with spindles disposed in parallel to each other. Each winding unit having one spindle continues to wind a yarn until the amount of yarn wound thereon, calculated or detected, is reached to a predetermined value. Then the finished or fully wound package is doffed by an worker or an automatic doffing device from the unit and thus replaced by an empty take-up tube for having the yarn be wound thereon.

The known automatic winder described hereinabove produces a predetermined number of the fully wound package. To this end, the winder includes a yarn-length adjustable device or a cone shape regulation device adapted to send a fully wound signal of each winding unit to a controller unit, which adds a value +1 in its memory each time the fully wound signal is received. When the total of the added value becomes equal to a predetermined value, the controller issues a stop signal to all the winding units to stop their winding operation.

Each winding unit continues its winding operation immediately before the controller unit issues the stop signal. At this time, the yarn packages of respective units vary in volume of yarns on cradle arms of the units, and thus the stop signal results in producing a large number of semi-finished packages. The semi-finished packages are discharged from the units, and then collected into another winding units where the yarns are rewound into a yarn package of a predetermined volume. This arrangement requires to dismount and mount the large number of the semi-finished packages each time the production cycle is changed in lot, which is tedious and laborious for the operator.

This system further needs to work on the bobbins which supply yarns during the lot change since the demand of the yarn to the bobbins is stopped halfway when the winding units are stopped and thus a large number of bobbins are remained in a condition of half consumed yarn, thereby causing a great inconvenience in changing the lot.

OBJECT AND SUMMARY OF THE INVENTION

It is an object of the present invention to provide a method and apparatus for performing the lot-change with a great efficiency by minimizing the production of semi-finished packages.

According to an embodiment of the present invention, a method of changing bobbins in lot for an automatic winder comprises the steps of: hindering fully wound winding units from further winding yarns when an amount of a residual yarn supply becomes smaller than a predetermined value; and discharging bobbins with residual yarn from the fully wound winding units to deliver the same to the other winding units being in winding operation, the winding of the preceding lot is completed such that the bobbins positioned at the last-completed winding unit have a substantially zero amount of residual yarn supply remained thereon.

The number of working winder units gradually decreases from a specific point in time and the winding of the preceding lot is completed such that when the lot volume of yarns are rewound no residual thread remains on the bobbins located any winding units, and the number of semi-finished or half-finished thread packages is one or a few.

BRIEF DESCRIPTION OF THE DRAWINGS

FIGS. 4–6 are views a means for loading a tray to the winding unit according to an embodiment of the invention, in which FIG. 4 is a plan view showing an operation of the system, FIG. 5 is a front view showing a relationship between a tray and guide plates 36, 37 and 38, and FIG. 6 is a schematic perspective view of relationship of the same;

DETAILED DESCRIPTION OF PREFERRED EMBODIMENTS

With reference to the accompanying drawings, exemplary embodiments of the present invention are described hereinbelow.

Figure 10:
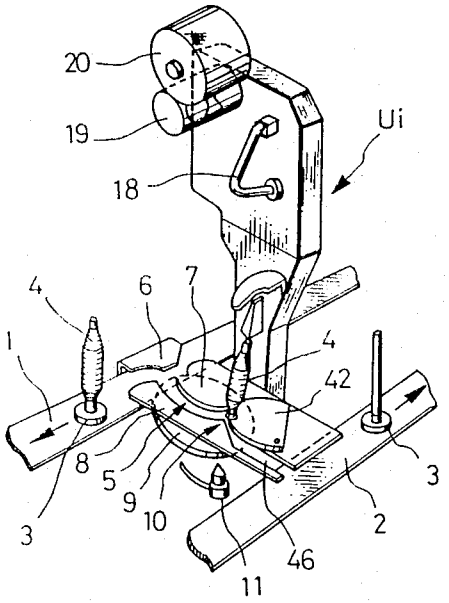
FIG. 10 is a schematic perspective view of a winding unit according to an embodiment of the invention.
Figure 11:
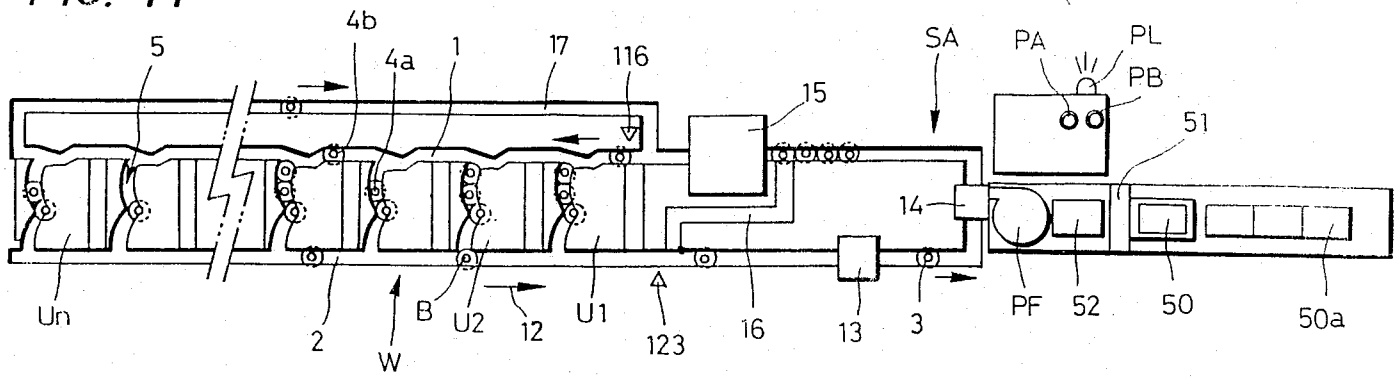
FIG. 11 is a plan view showing a bobbin transporting and supplying system according to an embodiment of the invention being disposed in the winding system.

FIGS. 10 and 11 show an instance of an automatic winder to which the present invention is applied. A plurality of winding units U1 to Un disposed in series constitutes a winder system W. The winding units are disposed between a spinning bobbin transporting passage 1 and an empty bobbin transporting passage 2, along which each spinning bobbin 4 mounted on a tray 3 is moved to be automatically led to a channel 5 by means of fixed guides plates 6, 7 and 8 and a rotary disk 9 as shown in FIG. 10, thereby keeping a predetermined member of spinning bobbins in stock there. Disposed below a rewinding point 10 is a compressed air nozzle 11, which supplies a jet of air via an air channel of the tray to a take-up tube of the bobbin so as to blow up one end of the yarn having been suspended from the upper end of the take-up tube. The blown-up end of the yarn is arrested by a waiting suction pipe 18, which in turn guides the yarn end to an end joining device, not shown. The yarn is rewound to form a yarn package by a traverse drum 19, a yarn clearer and the like of the winding unit.

The bobbins discharged from the winding unit are delivered together with a tray along the empty bobbin transporting passage 2 in a direction of an arrow 12 to a bobbin processing station 13, where the bobbins of substantially or almost empty are dismounted from the trays, and then the empty trays 3 are delivered to a bobbin supply station 14, where the empty tray is loaded with a spinning bobbin to be delivered to the foregoing winding unit passing through yarn end finding device 15 for finding the yarn end.

Among the bobbins discharged from the winder there included are so-called half-consumed bobbin which has a large volume of a yarn remained thereon and a surplus bobbin described later on, both being discharged from the winding unit because of difficulty of joining the yarn end. It is possible for these bobbins to be supplied once again to the winding unit, and thus they are passed through the spinning bobbin supply station 14 via the yarn end finding device 15 to be delivered again to the winding units U1–Un.

Alternatively, such a bobbin may be delivered to the yarn end finding device 15 via a bypass 16 without passing through the stations 13, 14. Designated by reference 17 is a feed back circulation passage for guiding the spinning bobbins and the empty trays having failed to be supplied from the spinning bobbin transporting passage 1 to any winding unit.

The above-described bobbin supply station 14 includes a container box 50 for holding a plurality of bobbins, a loader 51 for relaying the bobbins from the box onto a conveyer 52, and a bobbin feeder PF, such as a spiral guide utilizing a micro wave vibration, for delivering the bobbins one at a time to a bobbin chute communicating to a tray. The bobbin box 50 holds a predetermined number of bobbins, the number being set forth in advance and registered in a controller unit 27 for calculating the amount of residual yarn supply. Reference numeral PA depicts a lot-change command button, which is pressed to start the control of the operation in preparation for changing the lot of the yarn supply. Reference numeral PB depicts a button for initiating the delivery of the bobbins of a new lot to the respective winding units of the winder after the rewinding of the preceding lot is finished. The button PB is pressed to start discharging the bobbins of new lot from the bobbin box, delivering the bobbins to the bobbin feeder PF, actuating the yarn end finding device 15, and controlling the respective winding units described later on.

Designated by reference numeral PL is an indicator lamp which is lit upon completion of the rewinding of the bobbins in the preceding lot or of the delivery of the bobbins in the new lot.

According to the present invention, a method of changing the bobbins in lot is performed with the above-described winder as follows.

Figure 1A:
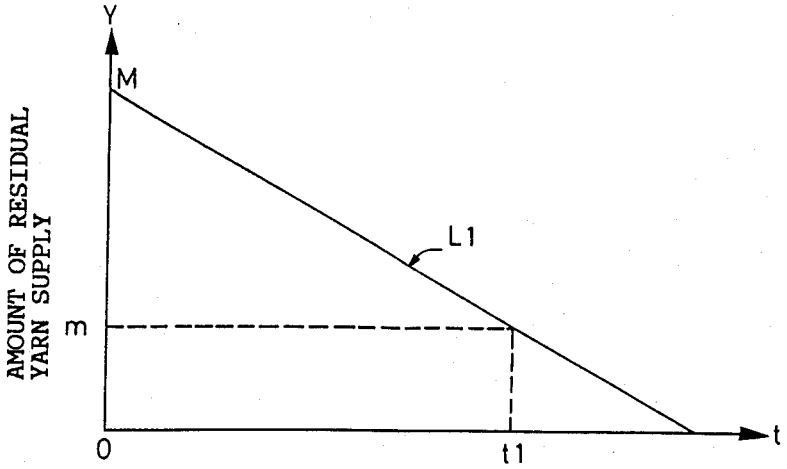
FIG. 1*a* and 1*b* are charts showing a timing for starting a lot-change control according to an embodiment of the present invention.
Figure 2:
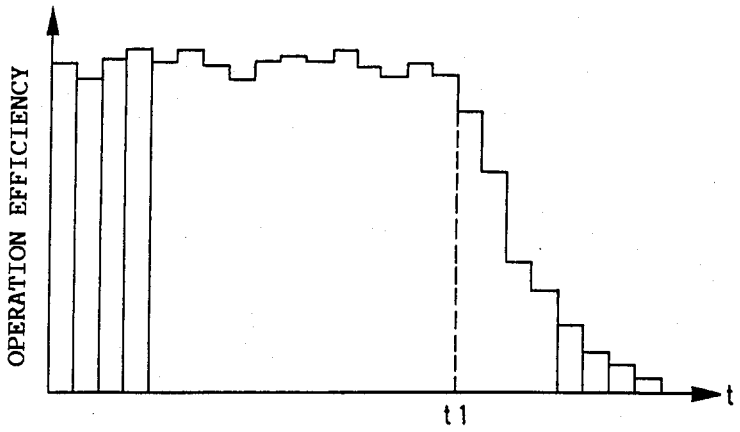
FIG. 2 is a graph showing a change in operation efficiency under the control.

In FIGS. 1*a* through 2, a winder includes ten spindles, i.e. ten winding units U1–U10, and is set to wind the yarn of M meters per one lot. As shown in FIG. 1*a*, the amount of residual yarn supply or demand yet to be rewound at a given time (t=0) is depicted by Y=M. Through the transition of the winding operation, finished or fully wound packages are produced in succession, while the amount of the rewound or consumed yarns is measured by a yarn length adjustable device.

An amount of residual yarn requirement is defined to be a residual amount of yarn which is obtained by deducting the amount of yarns having been rewound on packages in each winding unit at the time of measurement from predetermined amount of yarn required to obtain full wound packages in all winding units of a winder.

The amount of residual yarn requirement is the residual amount which is required for producing full packages in all winding units included in the automatic winder. For an example as shown in FIG. 1*c*, residual 5,000m (an oblique line portion e1) is required for producing a full wound package of 10,000m in a unit U1 if 5,000m is already wound on a package at the time of measurement. The amount which is obtained by adding the oblique line portions e1 to e10 of all units U1 to U10 is the amount of residual yarn requirement at the time of measurement.

Figure 1B:
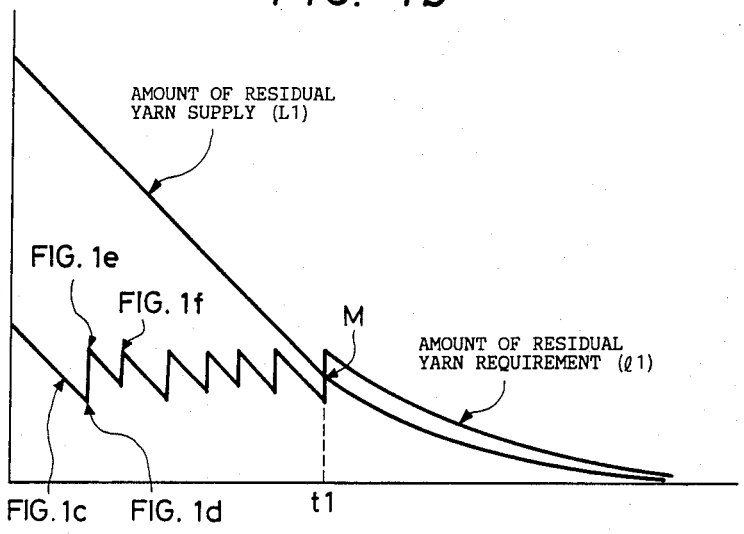
Figure 1C:
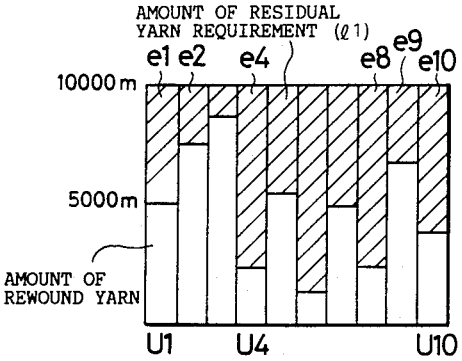
FIGS. 1*c*–1*f* are graphs for illustrating an amount of residual yarn requirement in each winding unit.
Figure 1D:
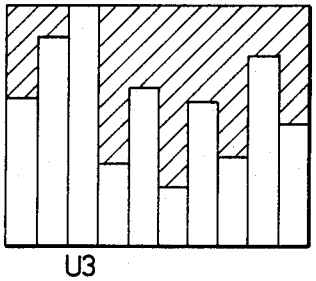
Figure 1E:
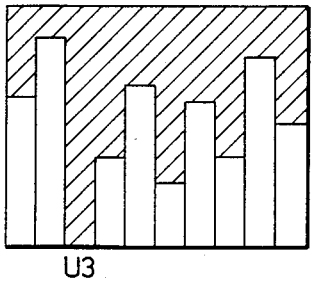

Accordingly, after a lapse of a certain time and winding condition is transferred to FIG. 1*d* from FIG. 1*c*, a full package is produced in the unit U3 and a doffing lamp for displaying a production of a full package is put on and the residual yarn requirement at the time is shown in FIG. 1*e*. The residual yarn requirement in the unit U3 is equal to the yarn amount for one full package if winding operation is newly started in the unit U3.

Figure 1F:
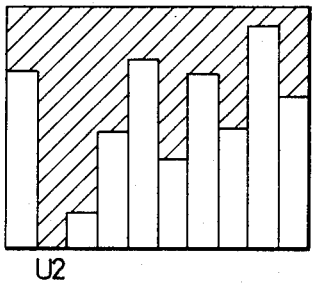

Further, some times lapse and a full package is produced in the unit U2 as shown in FIG. 1*f* and the amount of residual yarn requirement is illustrated as the area of the oblique line portion. The measurement of the yarn amount is done when a full package is produced in any of the winding units.

Accordingly, the amount of residual yarn requirement l1, which is defined as mentioned above, is varied from the starting point of the yarn winding operation for one lot to the end point thereof in a zigzag line as shown in FIG. 1*b* while the amount of residual yarn supply L1 for one lot is decreased substantially linearly or in smoothed curved condition. The control of the winding operation in each winding unit is started from the time t1 when the amount of residual yarn requirement l1 becomes greater than the amount of the amount of residual yarn supply L1 (at the step 105 in FIG. 13). From a point in time m that the amount of residual yarn requirement becomes greater than the amount of residual yarn supply, the control of the winding units, the bobbin transporting passages, and readying devices are started. The foregoing point m is referred to as a, control starting point for winding operation in each winding unit.

On and after said control starting point, any winding units having formed the finished full yarn packages are kept closed and out of operation while no new supply of the spinning bobbins thereto is prohibited and all the bobbins remained in the units are discharged therefrom. It is controlled to supply the bobbins thus discharged to the other winding units in operation. More particularly, the ten winding units continue their normal winding operation up to a certain point in time t1, and the number of working units at a given time is fluctuated as shown in a graph of FIG. 2. The working winding units decrease gradually in number from said point t1 until the predetermined amount of the yarns set forth for one lot is reached, when the last one or few working units are stopped with semi-finished yarn packages, i.e. one or few semi-finished packages or few semi-finished yarn package mounted thereon.

Said amount of residual yarn supply is depicted by a straight line L1 of FIG. 1. In FIG. 11, the amount of residual yarn supply is the sum of the yarns of bobbins 4a located at stand-by points in the winding units, bobbins 4b being delivered to the winding units, and bobbins remained in the bobbin feeder PF and on the conveyer 52. A yarn length for one bobbin, and the number of bobbins waiting in one winding unit and of bobbins being in delivery are set forth by an averaged value based on test results or theory. In the bobbin supply station 14, a series of bobbin containing boxes 50 called as spinning bobbin box are waiting to be supplied, and teh system is controlled to start to calculate and compare the amount of the residual yarn at the point in time that the last box 50a for one lot is loaded into the bobbin feeder PF. Therefore at the time of a command switch for changing the lot is turned on, it can be known how many bobbins are present in the winder and a dressing area SA, i.e. the amount of residual yarn supply. The thus obtained amount of residual yarn supply is consecutively compared with said amount of residual yarn requirement, and the time point when the amount of residual yarn requirement becomes greater than the amount of residual yarn supply is the control starting point m for the respective winding units for changing the lot.

An apparatus for performing the above-described control is now described hereinbelow.

Figure 3:
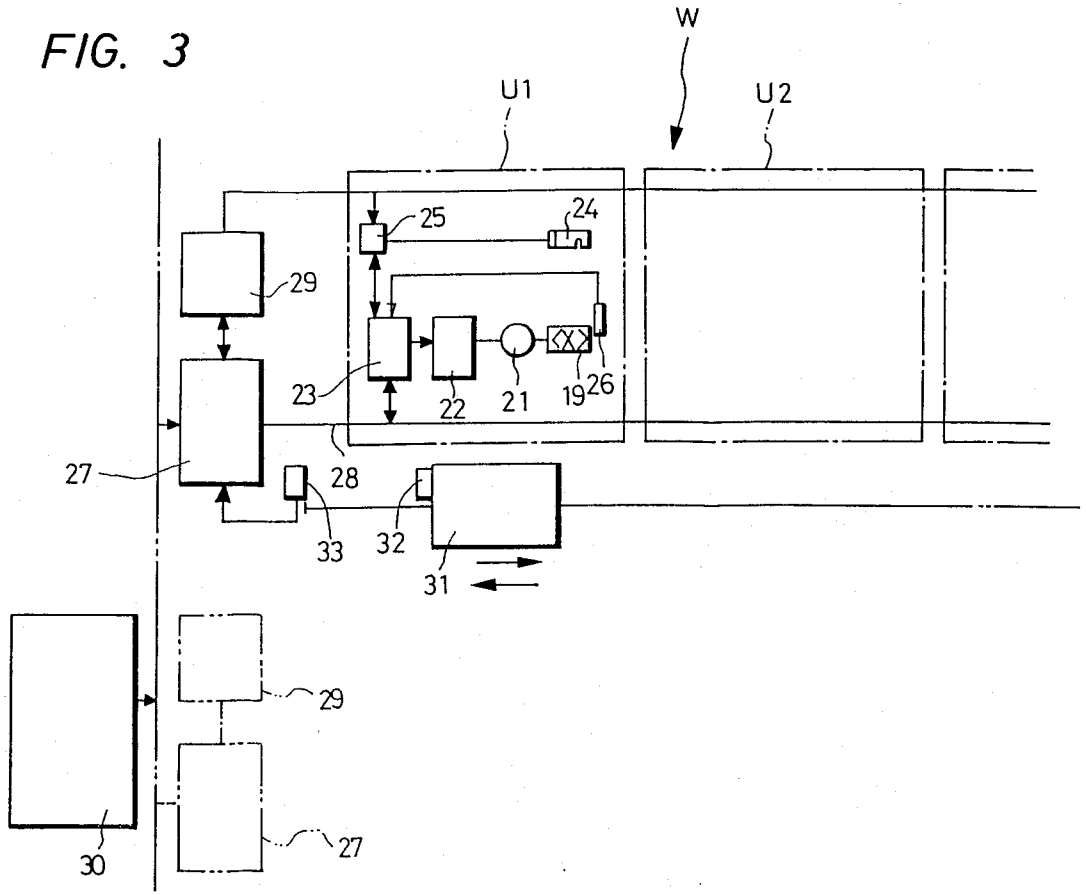
FIG. 3 is a diagram showing a control system according to an embodiment of the invention.

FIG. 3 is a diagram showing a system for performing the control described herein above. The winding unit is indicated by a box U1 of one-dot-and-dash line. A plurality of the units are disposed in series to constitute a winder system W. The winding unit U1 includes a traverse drum 19, a drive motor 21 for driving the drum, an invertor 22 for controlling the motor, a winding unit controller 23 for sending a command to the invertor, a detector head 24 for detecting a yarn defect and an amplifier 25. Further a proximity sensor 26 is disposed in proximity with an end surface of the drum 19 for detecting the rotation of the latter, and sends the detected rotation signal to the unit controller 23 for controlling the predetermined length of the yarn of one lot. More particularly, a specific pulse is received by the controller 23 per one rotation of the drum so as to be converted to a length of running yarn or directly recorded such that when the thus detected or added pulses reach to the predetermined value, it is judged that the winding unit has formed a finished yarn package.

A yarn running signal detected by the yarn defect detector head 24 is also sent together with the signal of said sensor 26 to the winding unit controller 23, and the length of the yarn actually rewound is known by passing the both signals through AND circuit.

The winder system W further includes a system controller 27 incorporating a microcomputer for controlling the whole system of the winding units, the controller having a signal bus 28 for receiving information from the respective winding units and sending a command signal to the respective units. Designated by 29 is a clearer controller which controls yarn-defect detecting clearers. The system controllers 27, 27 disposed for each machine frame are connected to a central control unit 30 via a bus for sending and receiving an information therebetween.

Reference numeral 31 in FIG. 3 depicts an automatic doffing truck moving along the winding units. The truck stops at a winding unit issuing a doff-request signal to take the finished yarn package off the unit and then to supply a new empty take-up tube in an automatic manner to restart winding the yarn. There are various types of doffing truck already proposed and operated.

According to the present invention, the automatic doffing truck 31 and the system controller 27 are connected to each other for an optical communication by means of a light emitter and phototube 32 disposed on the truck and the light emitter and phototube 33 disposed on the machine frame. For instance, the information such as the number of doffing performed by the automatic doffing truck and the location of the truck 31 are sent from the truck 31 to the system controller 27 while the controller 27 sends informations such as a travel command signal to move the truck right or left, and forward or rearward, a command signal to restart the winding of the yarn subsequent to the doffing, otherwise to stop the winding operation.

Figure 4:
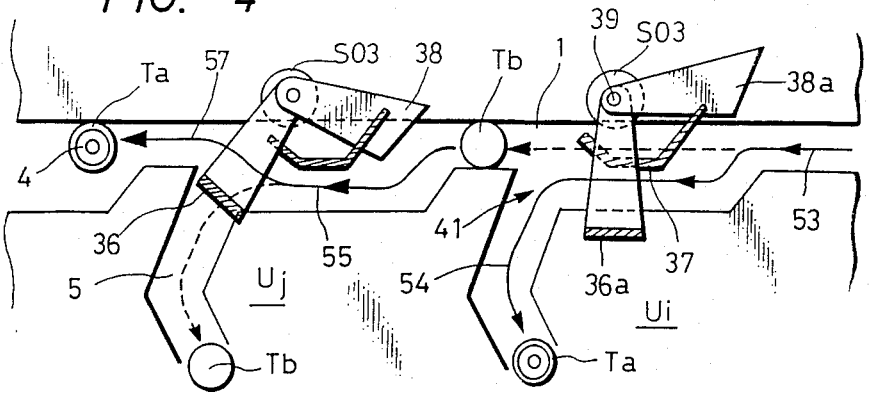
Figure 5:
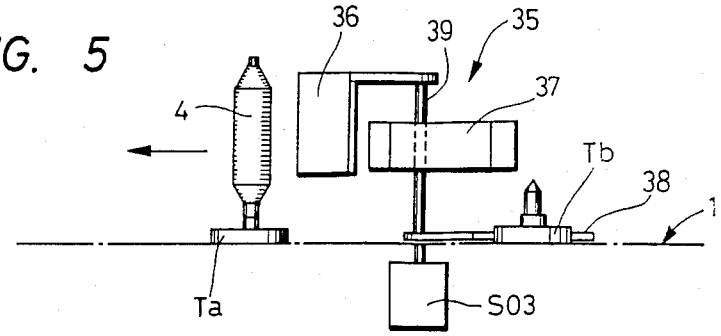
Figure 6:
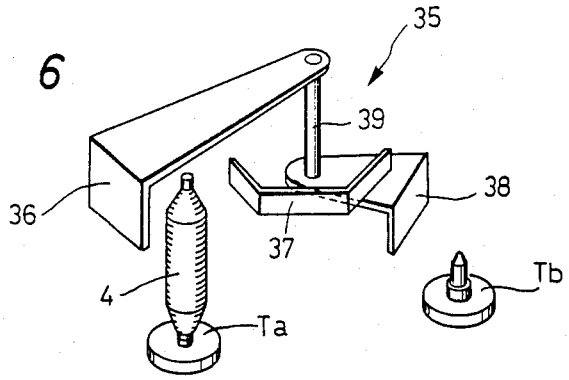

FIGS. 4 to 6 show tray selectors 35 according to an embodiment of the invention, each of which is disposed adjacent to a bobbin inlet port of the respective winding units and selectively permit the entrance of either of the loaded tray or the empty tray to the unit. The selector 35 includes bobbin guides 36, 37 engageable with the bobbin for guiding a loaded tray Ta, and a tray guide 38 engageable exclusively with the tray for guiding the same. One of the bobbin guide 36 and the tray guide 38 are fixed to a rotary shaft 39 and are driven to move between two positions in a unitary manner by a drive means such as a rotary solenoid SO3. The bobbin guide 36 is movable between one position where the inlet port 41 is closed and the other position where the same is opened, while the tray guide 38 is movable between one position where the transporting passage 1 is divided into two paths to guide an empty tray Tb to move in two directions and the other stand-by position. The bobbin guide 37 is disposed fixedly and projects in the transporting passage 1 so as to deflect only the loaded tray Ta toward the inlet port 41. The bobbin guides 36, 37 are disposed at such a level that the tray with no bobbin mounted thereon is allowed to pass underneath the same, as shown in FIG. 5.

With the rotary solenoid SO3 set in a reset mode, the tray selector 35 is located at such a stand-by position as that of a winding unit Ui, where the loaded tray Ta delivered along the transporting passage 1 in a direction of an arrow 53 is guided to move along a path 54 to be loaded into the winding unit Ui via the inlet port 41 while the empty tray Tb is allowed to move straight under the bobbin guide 37 and past the inlet port 41 without being loaded into the winding unit Ui. Thus with the rotary solenoid SO3 set in the reset mode, only the loaded tray Ta is allowed to be loaded into the winding unit and the empty tray Tb is not allowed to be loaded.

On the other hand, with the rotary solenoid SO3 set at a set mode as is the case with a winding unit Uj, the tray guide 38 projects into the transporting passage 1 to guide both the empty tray Tb and the loaded tray Ta to move along a path 55. The loaded tray Ta is hindered by the bobbin guide 36 disposed at the inlet port 41 from entering the unit to thereby advance along a path 57 and past the winding unit, while the empty tray Tb passes underneath the bobbin guide 36 to enter the channel 5. Thus with the rotary solenoid SO3 set at the set mode, the loaded tray Ta is prohibited from entering the winding unit and the empty tray Tb is allowed to enter the unit.

Figure 7:
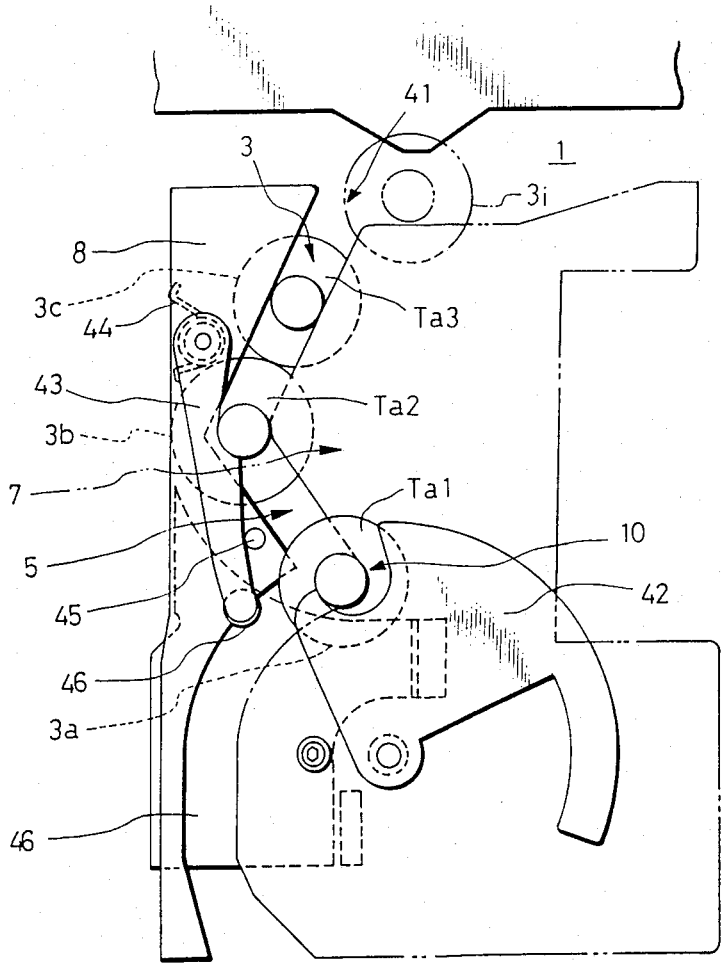
FIG. 7 is a plan view of a channel for tray and an ejecting lever of the winding unit of an embodiment of the present invention.
Figure 8:
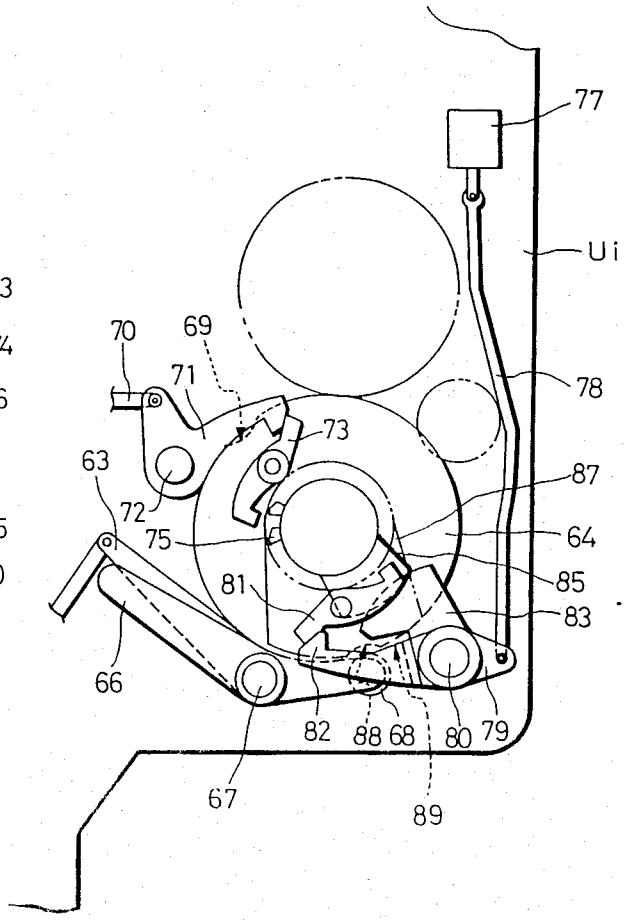
FIG. 8 is a side view showing a drive unit for the ejecting lever 42.
Figure 9:
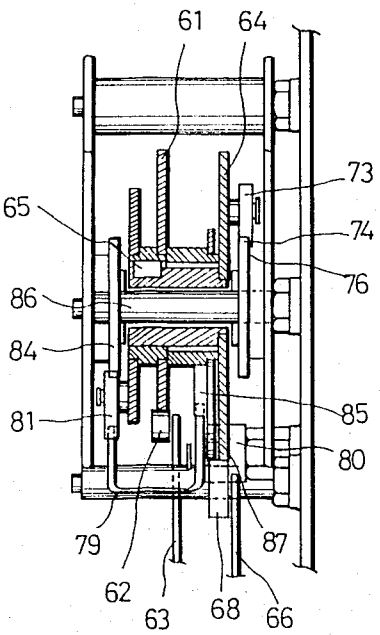
FIG. 9 is a front view of FIG. 8.

With reference to FIGS. 7 to 9, now described hereinbelow is an ejector unit for discharging the loaded tray Ta and the empty tray Tb from the winding unit during the lot-change control mode.

The bobbin is discharged from the winding unit by actuating an ejecting lever 42, the bobbin positioned at the winding point is ejected by one motion of the lever.

In FIGS. 8 and 9, the ejecting lever (42 of FIG. 7) is driven by a cam lever 63 with an ejecting cam 61 held against a cam follower 62 via a connecting rod, not shown.

In the above-described embodiment, the ejecting cam 61 and a blow-up cam 64 is connected to each other by a key 65 for an unitary rotation such that upon the arrival of a new bobbin at the winding point, a valve of the compressed air nozzle 11 disposed below the winding point as shown in FIG. 10 is opened to supply an air jet through the space of the tray to the central bore of the bobbin to thereby blow up an end of the yarn suspended thereinto.

It is therefore necessary for the air jet to be prohibited when the bobbin is discharged from the unit as the yarn package is finished, and thus only the bobbin is discharged. Reference numeral 66 depicts a valve actuator lever for the compressed air pivotally supported on a fixed shaft 67. The valve actuating lever 66 has one end connected to a valve actuating member and the other end forming a cam follower 68, which enters a recess 69 of the blow-up cam 64 for causing the lever 66 to be actuated. During the normal operation, a command signal for changing the bobbins actuates the drive means such as a solenoid to pull a rod 70, whereupon a hook lever 71 is angularly moved about a fixed shaft 72 counterclockwise through a certain degrees of angle. At this time, a clutch hook 73 supported on the blow-up cam 64 is urged by a spring to turn counterclockwise and is brought into intermeshing engagement with one of teeth 75 on a clutch 74 with the result that the blow-up cam 64 rotate together with the clutch 74 rotating with a gear 76. Thus the ejecting cam 61 connected to the blow-up cam 64 is rotated, thereby exerting the discharge of the bobbin and the blow-up of the yarn end of the succeeding bobbin in a timed relation.

To discharge the remaining bobbins from the winding unit after the yarn package is finished, the controller 27 or 30 issues a command signal to energize the solenoid 77 of FIG. 8, which in turn causes a release lever 79 to turn about a fixed shaft 80 via a rod 78 through a predetermined angle. The release lever 79 has an abutment 82 and a release segment 83, both being formed integrally with the lever. The release lever 79 rotates to causes the clutch hook 81 to intermesh with one of teeth of the clutch 84, the clutch 84 having teeth similar to those of the clutch 74. At this time, a segment 85 intermeshed with the release segment 83 is rotated clockwise about a shaft 86 through a predetermined angle, and an air-jet buffer plate 87 formed integral with the segment 85 is rotated in the same direction. Said buffer plate 87 has a recess 88 formed on the periphery thereof. With the recess located at a position shown in FIG. 8, the cam follower 62 is caught in the recesses 69, 88 at the time that the recess 69 is brought in registry with said recess 88 as the blow-up cam 64 rotates, thereby permitting the valve actuating lever 66 to actuate. However, when the release lever 79 is actuated by the solenoid turned on, the air-jet buffer plate 87 formed integral with the segment 85 is rotated slightly to displace the recess 88 of the buffer plate with respect to a roller 68, and with the result that the roller 68 is blocked by a normal peripheral surface 89 for thereby keeping the lever 66 inactive even when the recess 69 of the blow-up cam 64 is positioned in registry with the roller 68.

Since this arrangement prevents the compressed air jet from being sent out during the discharging of the bobbin at the winding unit having finished the yarn package after the control of the system for the lot-change, the bobbin is discharged without permitting the yarn end to be blown out the central bore of the bobbin, thereby keeping the yarn end free from being arrested by other parts of the system.

When the winding unit has two stand-by points for holding the bobbins as shown in FIG. 7, the release solenoid 77 is energized three times to discharge all the bobbins including one bobbin disposed at the rewinding point. It is preferable that the yarn leading from the yarn supply bobbin to the yarn package is positively severed when the rotation of the traverse drum is stopped upon completion of forming the fully wound yarn package. Thus the yarn supply bobbin is dishcarged preferably with its yarn cut off the package. To this end, the winding unit is provided with a conventional cutter, which is actuated by a signal indicating that the yarn package is finished.

A method of changing the bobbins in lot according to the present invention is described hereinbelow. In this particular embodiment, the winder system includes the bobbins each mounted on a separate tray for transportation, and empty trays holding neither the spinning bobbin nor the empty bobbin are stored in the transporting passages formed in the winder (thus the passages of the winder is utilized). Otherwise, the winder system may be of a known magazine type in which the winding units are provided with a plurality of cylindrical magazines holding the spinning bobbins therein, or of another type in which the winding units are circulated.

Figure 12:
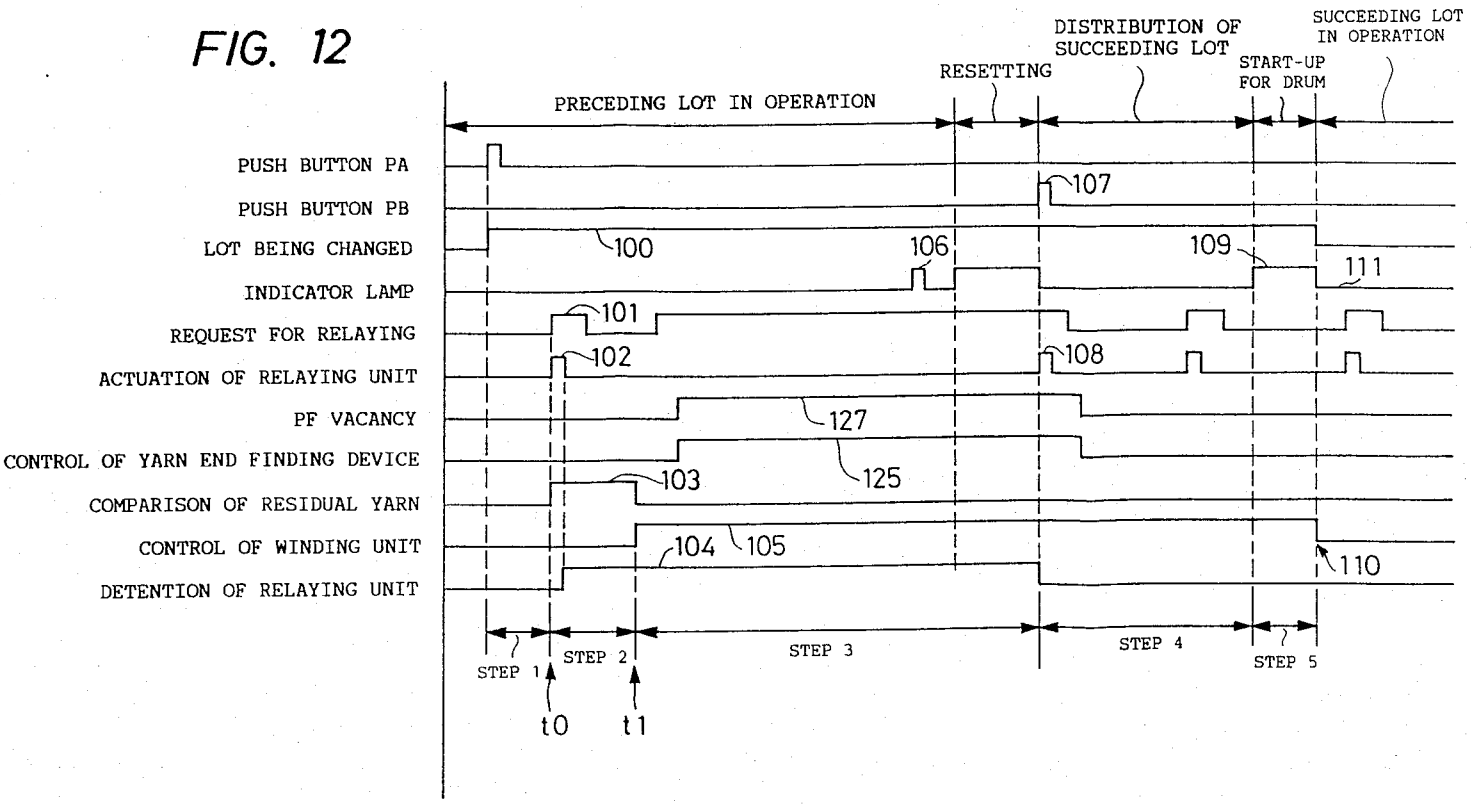
FIG. 12 is a overall timing chart for a lot-change.

FIG. 12 shows a timing chart showing the operative timed relation between the respective parts, the winding units, the yarn end finding device, the relaying of the bobbins and so on. A push button PA is pressed to start control of the lot-change 100. After the button is pushed, the winding operation ordinarily continues (step 1) and the control becomes effective form a point in time 101 when a request for relaying a bobbin is sent to the relaying unit. At this moment, a motion 102 of the relaying unit takes place and the number of spinning bobbins located within the winder, that is, an amount of residual yarn supply is automatically determined, thereby starting to make comparison 103 between the residual yarn supply and the an amount of residual yarn requirement calculated from the amount of the yarn having wounded into the package at that time. On and after this moment, the relaying unit is prohibited 104 from being actuated and thus no new bobbin is supplied into the winder.

When the amount of residual yarn requirement becomes greater than that of residual yarn supply t1, control 105 of the winding units is started. The process from the start t0 of comparing said residual yarn supply with the residual yarn requirement from the start t1 of controlling the winding unit is referred to as step 2. In the succeeding step 3, control of winding operation at the winding unit, i.e. of the unit having completed a full yarn package and of the unit continuing to wind the yarn to form the package, and finally completing the winding of for the preceding lot with almost all the winding units finished the yarn package and hence with no spinning bobbin, that is, no yarn supply is present in the winder area.

Upon completion of the winding of the preceding lot, an indicator lamp is lit 106, the operator starts to prepare for winding the yarn of a succeeding lot. Namely, the operator replaces the paper take-up tubes, removes the semi-finished yarn packages, examines the amount of residual yarn supply, newly sets the conditions of tension devices of the respective winding units, slab catchers and an amount of yarns to be wound, and inputs those into the controller unit 27.

Then the push button B is pushed 107 to thereby start step 4, in which step the bobbin box loaded with a new lot is relayed 108, and the winding units get ready for the winding. When the indicator lamp is lit once again 109 as the distribution of the bobbins of the new lot is finished, the operator starts the drum (step 5). At this time, the ordinary winding of the new lot starts and the control of lot-change is completed to turn off the lamp 111.

The unit control exerted in step 3 is now described with reference to FIGS. 13 and 14. The push button A is pushed to issue a command signal of lot-change, whereupon the control of the controller unit 27 and the yarn end finding device 15 is started. When the amount of residual yarn requirement becomes greater than the amount of residual yarn supply as described hereinabove, the control 105 of the winding units are started. After this control is started, the winding unit turns on its lamp 114 to indicate the completion of forming the yarn package, which is then automatically doffed or taken off 115.

More specifically, the winding units U5, U2, U10, U7 successively complete there yarn packages in this order as shown in FIG. 1. During this time, the other units continue to carry out the ordinary winding operation and no bobbin remains in the bobbin supply station 14 of FIG. 11, thus only the empty trays passing through the yarn end finding device 15 to move toward the winding units. When the empty-and-loaded-tray detector unit 116 detects first few empty trays, the controller unit 27 sends the command signal to energize the ejecting levers (42 of FIG. 7) of the winding units U2, U5, U7 and U10, successively for discharging the remained trays from the winding units to the transporting passage, while the solenoid SO3 of FIG. 4 is turned on to prohibit the entrance of the loaded bobbins into the winding units. For example, when there remain three loaded bobbin trays Ta1, Ta2 and Ta3 in the channel 5 of the winding unit in FIG. 7, a one time action of the ejecting lever 42 causes the loaded bobbin tray Ta1 to be discharged from the rewinding position 10, to which the loaded bobbin tray Ta2 moves from the stand-by position, thereby permitting the succeeding loaded bobbin tray Ta3 to move to the vacant stand-by position, with the result that a vacant position for one tray is provided in the channel. At this time, an empty tray Tb being transported along transporting passage 1 is allowed to enter the channel 5 passing beneath the bobbin guide 36 of FIG. 4 when it arrives at that position. With three time actions of the ejecting lever 42 as indicated by 117 in FIG. 13, all the three spinning bobbins are ejected from the channel of the winding unit, and three empty bobbin trays are stored for thereby setting this winding unit at a stand-by mode 118. The spinning bobbin thus discharged is transported along the transporting passage 2 in the direction of an arrow 12, and then it moves through the bobbin plow station 14, the bobbin supply station 14 and the yarn end finding device 15 to be delivered to one of the other winding unit being in operation for rewinding. In the winding unit being in operation, the bobbin guide 36 is positioned at the stand-by position **36*a* as shown in FIG. 4 for guiding the spinning bobbin to move along a path 54 to be supplied to the winding unit. That is, as shown in FIG. 14**, the spinning bobbin having ejected through the first ejection from the unit U2 is delivered to a given one of the winding units U1, U4, U6, U8 and U9 being in operation, and the spinning bobbin discharged from the unit U1 is supplied to one of the other winding units U4, U6 and U8. With this arrangement, the winding unit having finished the yarn package is kept inoperative with no yarn being supplied.

Figure 14:
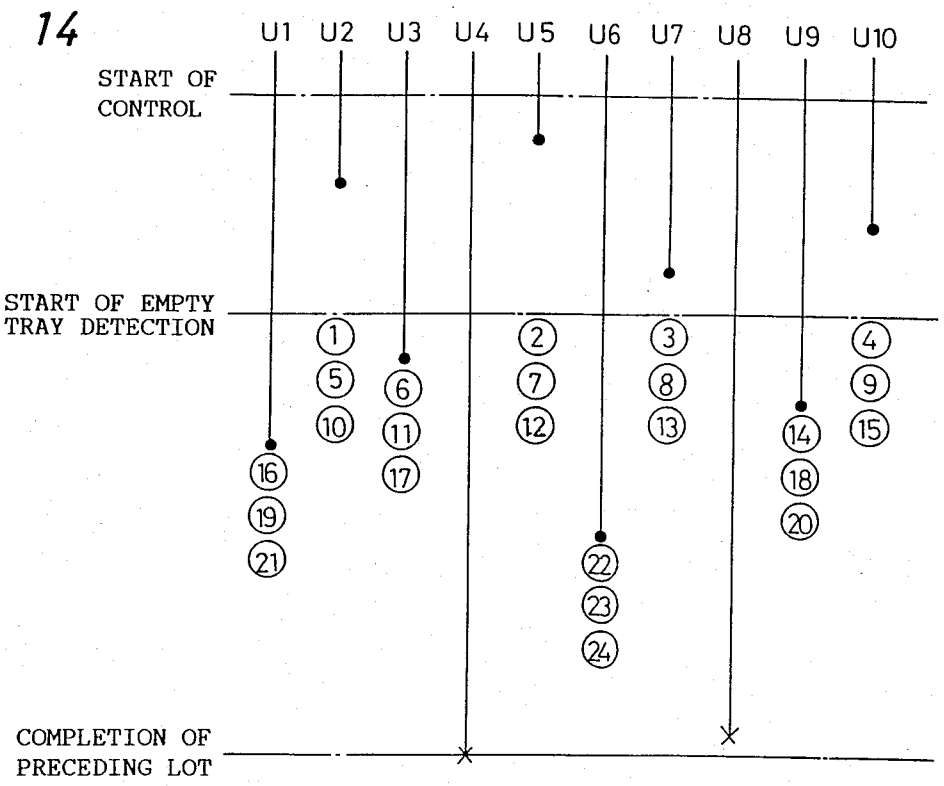
FIG. 14 is a chart showing an order of ejection upon the completion of operation of a preceding lot.

Depicted by a black dot in FIG. 14 is the point in time when the yarn package is completed, and numbers in row for respective winding units indicate the order in which the ejection takes place at the unit. More particularly, the ejection takes place in the order indicated by the number of FIG. 14 each time the empty/loaded tray detecting unit 116 of FIG. 11 detects an empty tray. It is also possible for one winding unit to exert the ejection three times in succession. The ejection is exerted preferably in the order shown in FIG. 14 so as to ensure that the empty tray is supplied to the desired unit without fail, and thus to avoid a time lug between action of the ejecting lever and detection of the empty tray being moved along the transporting passage adjacent thereto in case of the succeeding ejections of one unit, such time lug causing the failure of arresting the empty tray.

The winding units having finished the yarn package complete the ejection successively in this way, thereby leaving only a few loaded trays in the winder system. Then in case of FIG. 14, the residual supply yarn are rewound in the units U4 and U8. At this time, with no bobbins remained for supply 119, failure (120) of joining yarn of splicing will be experienced if the yarn joining action is repeated a predetermined number of times, and thus a yellow button, that is, a yarn-joining failure sign (121) is turned on, thereby finishing the winding operation. Completion of the winding operation of the last winding unit U4 results in completing the operation for the preceding lot (122), and the indicator lamp 106 is lit.

Figure 13:
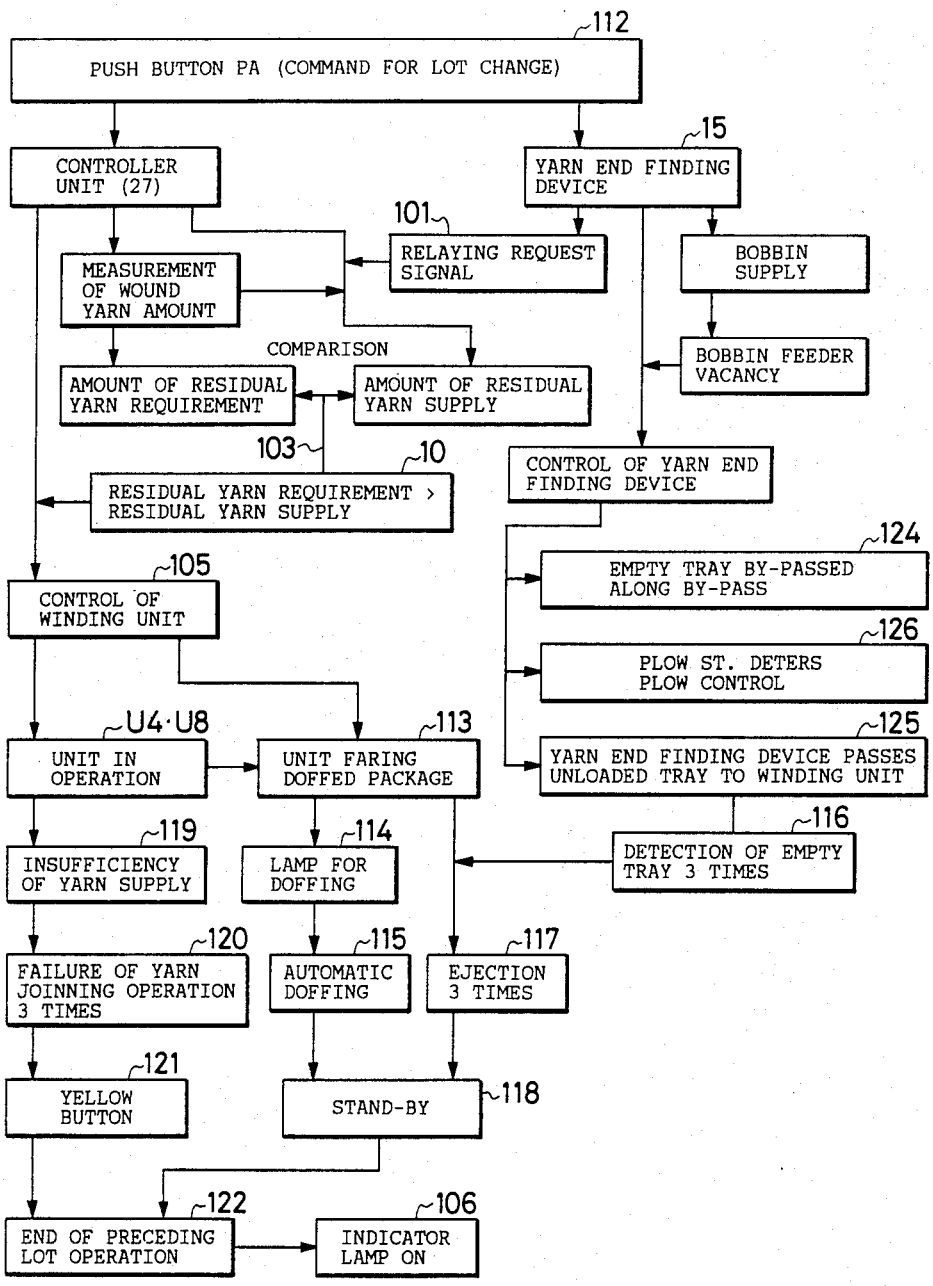
FIG. 13 is a flow chart showing a manner in which the system components operate in steps 1–3.

During the lot-change in the step (FIG. 12), the other devices or components of the system except for the winding units are controlled as shown in FIG. 13. If an empty tray is present in the empty or spinning bobbin transporting passage 2, the empty trays are detected by the empty tray detecting unit disposed in the bypass passage 16 and the thus detected tray is guided into the bypass passage 16 (control 124). If the empty tray is supplied to the yarn end finding device 15, the tray is kept free from undergoing the yarn end finding operation and is passed therethrough (125). In the normal operation of the winder, the trays are stopped at the bobbin processing station 13 and the empty bobbin is pulled out from the tray. The empty tray is ejected and delivered to the spinning bobbin supply station 14.

While, there is no spinning bobbin at the spinning bobbin supply station 14 during the controlling operation for lot-change so that spinning bobbins ejected from winding units are not stopped at the bobbin processing station 13 but to pass therethrough. Thus, control of empty trays is deterred (126). During this time, the bobbin supply unit PF has no stock of bobbins and is at vacancy (127) as shown in FIG. 12, detection of which vacancy is made while the yarn end finding device 15 is controlled to let the empty tray move past the same (125).

Figure 15:
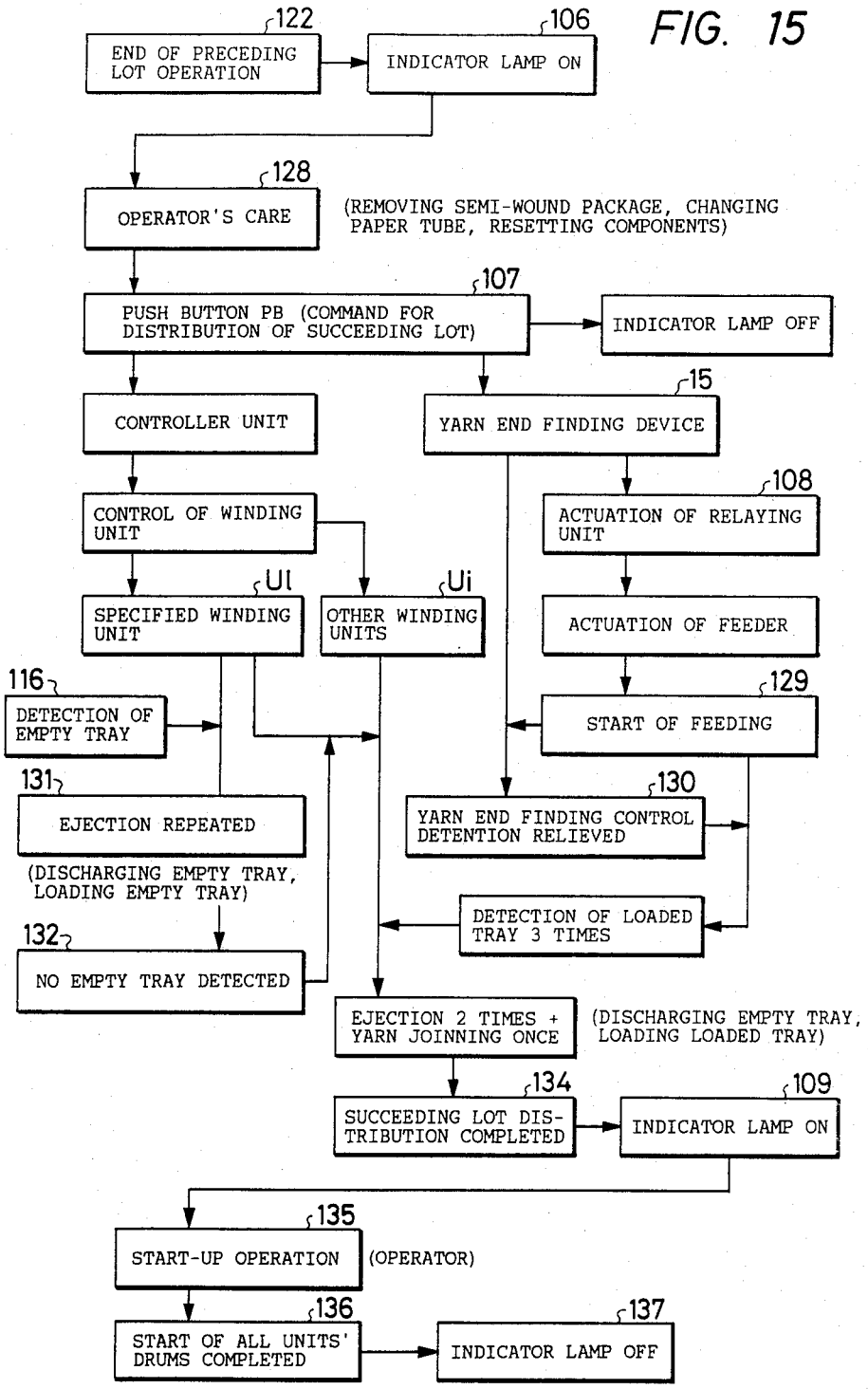
FIG. 15 is a flow chart showing the operation of the components in steps 4 and 5.
Figure 16:
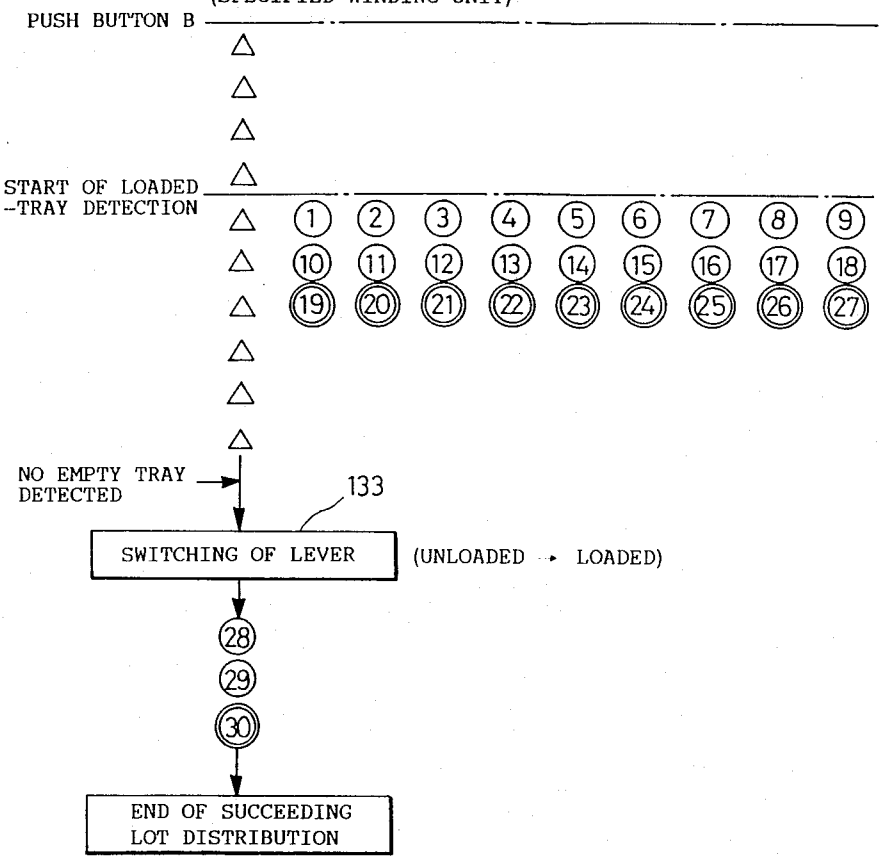
FIG. 16 is a chart showing an order of ejection at the time of distribution of bobbin of a succeeding lot.

Those are the controls for completing the preceding lot, and now the steps and of FIG. 12 is described hereinbelow with reference to FIGS. 15 and 16. At the time of completing the winding of the preceding lot, the winding units U1 to U10 have three empty trays reserved in each of the channels. And it is often the case that there are empty trays circulating in the transport passage 1 and the circulation passage 17. The operator removes the semi-finished yarn package produced at the winding units U4 and U8 from the same, and changes the take-up tube as well as readjust the various components for the winding of the succeeding lot (128).

Then the push button PB for sending the command of distributing the succeeding lot is pushed 107, and thus the step of FIG. 12 is started. The actuation of the push button PB first causes the relaying unit 51 to actuate 108 for supplying the spinning bobbins of the new lot to the bobbin feeder PF of FIG. 11, whereupon the bobbins start to be loaded to the empty trays being delivered to the bobbin supply station 14 (129), and the detention of the yarn end finding device is relieved (130) to start the ordinary operation.

A specified winding unit (the winding unit U1, for instance, of the present embodiment) of the winding units is adapted to repeat the ejection (131) of the empty trays Tb each time the circulating empty tray is detected by the detecting unit 116. More particularly, the specific winding unit serves as a passage for a specific purpose of conducting extra empty trays, which have not been led into any winding unit and is thus circulating in the transport passages 1 and 17, to the transport passage 2 for a predetermined period of time. To this end, the winding unit for this specific use has its bobbin guide 36 disposed at such a position of the inlet port as that of the winding unit Ui left hand unit of FIG. 4. The unit U1 thus dicharges one unloaded tray to the passage 2 and arrests other empty tray while the ejection is repeated (131). When no circulating empty tray is present (132), the winding unit is controlled to operate in the similar manner as the other winding unt Ui.

In a certain period of time subsequent to the actuation of the push button PB, the ejection takes place each time a spinning bobbin of the succeeding lot having its end found passes the point of the loaded/empty tray detecting unit 116 of FIG. 11. For example, if the detecting unit 116 detects a spinning bobbin, the winding unit U2 exerts a first ejection for discharging the empty tray from tthe winding position while the unit U2 permits said spinning bobbin to enter thereinto by causing the solenoid SO3 to reset the bobbin guide at a position shown in the right hand winding unit of FIG. 4. Then the same procedure is taken by the winding unit U3 when a second spinning bobbin is detected by the detecting unit 116. At this time, the second spinning bobbin passing through the inlet port of the winding unit U2. This is because the winding unit U2 has exerted only the first ejection and thus holds two empty trays and one loaded tray filling the channel 5, which does not permit the succeeding tray to enter the inlet port, thereby letting the succeeding tray reach to the winding unit U3. In this way, the winding units U2–U10 devoid of the specified winding unit U1 arrest the loaded trays successively in the order shown by the numbers in FIG. 16.

During the first and second ejections exerted by the winding units U2–U10, the solenoid 77 of FIGS. 8 and 9 is turned on so as to actuating only the ejecting levers 42 keeping the air jet and the yarn joining operations at an inoperative condition. When a third ejection is made by the winding unit U2–U10, the ordinary action for changing the bobbins is taken. Thus the yarn end of the bobbins at the rewinding position is blown up by the air jet and sucked by the suction pipe for yarn joining, thereby preparing the winding operation. In FIG. 16, a circle mark ○ depicts an ejection for discharging an empty tray and loading a loaded tray, and a double circle mark ◎ depicts an ordinary ejection exerting the yarn joining. A triangular mark Δ depicts an ejection for discharging an empty tray and also loading the empty tray.

When the loaded/empty tray detecting unit 116 completes the detection of the empty trays at the time of discharging the empty trays at the specific winding unit U1, that is, when no succeeding tray is detected a predetermined period time after the detection of a preceding tray, it is judged that none of the empty trays is present in the circulation passage 17 any more. At this time, the solenoid SO3 is switched to a reset position (133), the winding unit U1 starts to load the spinning bobbin in the similar manner as the other winding units. More particularly, twenty-eighth to thirtieth spinning bobbins are loaded into the winding unit U1, and thereby completing the distribution of the bobbins of the succeeding lot with the result that each of the units U1 to U10 has a predetermined number of spinning bobbins loaded therein. Thus the indicator lamp is lit 109 as shown in FIG. 15, which the operator confirms and commences a start-up (135) for the drum.

The operator manually winds a yarn end of the supply side on a take-up tube on the winding-up side ready in advance for the respective winding units, and then pushes a drum start button to start the winding of the yarn. In this way, start-up operation of all the winding units is completed (136) and the indicator lamp is turned off (137), thereby completing the one cycle of the lot change operation. Namely, the step of FIG. 12 is completed.

In the above-described embodiment, the lot size is detected by the length adjustable winding mechanism. Alternatively, the number of doffing operations taken by the doffing truck 31 of FIG. 3 may be summed to detect a predetermined size of one lot.

Determination of amount of yarn for one lot may be done upon the length of wound yarn or upon the number of packages, that is, upon the weight of packages.

If the amount of yarn for one lot is determined to be 100 packages and there are 10 units in a winder, control of winding units of the present invention is started when 90 packages are doffed (at m point in FIG. 12).

The empty trays may be alternatively stored at a special pool formed separately from the winding unit. In this case, the ejection for discharging the empty tray is omitted.

In the above-described embodiment, the bobbin supply unit utilizes the relaying unit. A lot-change method according to the present invention may be applied to a so-called spinning frame winder in which the winder is connected directly to the spinning frame.

According to the present invention, the supplied yarn of a preceding lot is all consumed to be wound with a minimum number of semi-finished packages produced, and thus omitting the care for a large number of semi-finished yarn packages produced in the conventional method of changing the lot, thereby performing the lot-change with a great efficiency.

What is claimed is:

1. A method of changing bobbins in lot for an automatic winder having a plurality of winding units, each winding unit being associated with a yarn package and being operable to receive a plurality of spinning bobbins from a spinning bobbin lot and to wind yarn from received spinning bobbins to the associated yarn package, said method comprising the steps of:

doffing a fully wound package from the winding unit by which the fully wound package is wound;

detecting the condition of the amount of residual yarn supply being less than a predetermined value, the residual yarn supply being defined as the amount of yarn remaining on the spinning bobbins of the spinning bobbin lot;

preventing the winding unit, in which the fully wound package is doffed, from further winding yarns when an amount of a residual yarn supply becomes less than a predetermined value;

discharging spinning bobbins received by the winding unit by which the fully wound package is wound when an amount of residual yarn supply becomes less than a predetermined value; and delivering discharged spinning bobbins to the other winding units being in winding operation so that the winding of the lot is completed with substantially zero amount of residual yarn supply.

2. The method as claimed in claim 1, further comprising the step of determining the amount of residual yarn supply by detecting the amount of yarn having been wound on packages in each winding unit and the amount of yarn of doffed packages and subtracting the detected amount from a predetermined amount of yarn required to be wound for one spinning bobbin lot.

3. The method as claimed in claim 1, wherein the automatic winder further has a bobbin feeder and a bobbin delivery path connecting the winding units and the bobbin feeder, each winding unit has a stand-by location for accommodating at least one spinning bobbin received by the winding unit, and said amount of a residual yarn supply comprises the total amount of yarn of spinning bobbins located at stand-by locations in the winding units, bobbins being delivered to the winding units and bobbins in the bobbin feeder.

4. The method as claimed in claim 2, wherein said predetermined value is the amount of residual yarn requirement at a time point when the amount of residual yarn requirement becomes greater than the amount of residual yarn supply, wherein said method further comprises the step of determining the amount of residual yarn requirement by deducting the amount of yarn having been wound on packages by the winding units from a predetermined amount of yarn required to obtain full wound packages in all winding units of the winder.

5. The method as claimed in claim 4, further comprising the step of supplying all of the spinning bobbins of the spinning bobbin lot to a bobbin feeder, wherein said step of determining the amount of the residual yarn supply begins following said step of supplying.

6. The method as claimed in claim 4, wherein each winding unit further has a traverse drum, and wherein said method further comprises the step of determining the amount of the yarn wound on packages by detecting the rotation of the traverse drum of each winding unit with a proximity sensor disposed in proximity of a surface of each traverse drum and providing a rotation signal in response to rotation of each traverse drum, detecting a yarn running between a spinning bobbin and a package in each winding unit with a yarn detector head, providing a yarn running signal in response to a yarn running between a spinning bobbin and a package, and providing a control signal in response to the occurrence of both said rotation signal and said yarn running signal.

7. The method as claimed in claim 1, further comprising the steps of mounting each spinning bobbin on a separate tray for transportation, supplying an air jet in normal winding operation through a space of the tray to the central bore of a received bobbin, blowing up an end of the yarn suspended in the central bore of the received bobbin, preventing the supply of the air jet during the discharging of the bobbin at the winding unit having finished the yarn package so that the bobbin is discharged without the yarn end being blown out of the central bore of the bobbin.

8. A method of operating a plurality of winding units to wind yarn from a plurality of spinning bobbins onto a plurality of yarn packages to fill at least one of the yarn packages, said method comprising the steps of:

winding yarn, with each winding unit, from a spinning bobbin of the plurality of spinning bobbins onto a yarn package;

detecting the total amount of yarn wound by the plurality of winding units;

determining the total amount of yarn required to fill the yarn packages being wound by the plurality of winding units;

comparing the total amount of yarn wound by the plurality of winding units with the total amount of yarn required to fill the yarn packages;

detecting a winding unit having a fully wound package; and providing a control signal upon a winding unit having a fully wound package and the total amount of yarn wound by the plurality of winding units reaching the total amount of yarn required to fill the yarn packages.

9. A method as claimed in claim 8, further comprising the steps of:

storing, ine ach winding unit, at least one spinning bobbin of the plurality of spinning bobbins for subsequent winding; and discharging the stored at least one spinning bobbin from the winding unit having a fully wound package in response to the control signal.

10. A method as claimed in claim 8, further comprising the steps of:

supplying the spinning bobbins to the winding units; and inhibiting the supplying of spinning bobbins to the winding unit having a fully wound package in response to the control signal.

11. A method as claimed in claim 9, further comprising the steps of:

supplying the spinning bobbins to the winding units; and inhibiting the supplying of spinning bobbins to the winding unit having a fully wound package in response to the control signal.

12. A bobbin processing apparatus operable with a plurality of bobbin supporting trays and a plurality of bobbin lots, each bobbin lot having a plurality of spinning bobbins containing a predetermined amount of yarn, said apparatus comprising:

a plurality of winding units, each winding unit having a yarn package and being operable to wind yarn from one of the spinning bobbins onto yarn package;

first detecting means for detecting the total amount of yarn wound by said plurality of winding units;

determining means for determining the total amount of yarn required to fill the yarn packages which said plurality of winding units are operable to wind;

comparing means for comparing the total amount of yarn wound by said plurality of winding units with the total amount of yarn required to fill the yarn packages;

second detecting means for detecting a winding unit having a fully wound package;

signal providing means, operatively connected with said comparing means and second detecting means, for providing a signal upon a winding unit having a fully wound package and the amount of yarn wound by the plurality of winding units reaching the amount of yarn required to fill the yarn packages.

13. A bobbin processing apparatus as claimed in claim 12, further comprising:

storing means, associated with each of said winding units, for storing at least one spinning bobbin for subsequent winding by the associated winding unit; and discharging means, operatively connected with said signal providing means, for discharging said at least one stored spinning bobbin in response to said signal.

14. A bobbin processing apparatus as claimed in claim 12, further comprising:

bobbin transferring means for transferring spinning bobbins to the winding units; and inhibiting means, operatively connected with said signal providing means, for inhibiting transferring of spinning bobbins to the winding unit having a fully wound package in response to said signal.

15. A bobbin processing apparatus as claimed in claim 14, further comprising:

storing means, associated with each of said winding units, for storing at least one spinning bobbin for subsequent winding by the associated winding unit; and discharging means, operatively connected with said signal providing means, for discharging said at least one stored spinning bobbin in response to said signal.

16. A bobbin processing apparatus as claimed in claim 14, wherein said bobbin transferring means comprises:

a first bobbin path arranged adjacent said plurality of winding units; and a plurality of second bobbin paths associated with said plurality of winding units, each of said second bobbin paths extending from said first bobbin path to the associated winding unit.

17. A bobbin processing apparatus as claimed in claim 16, wherein said inhibiting means comprises a plurality of movable bobbin guides each movable bobbin guide being associated with one of said winding units and being movable to a position traversing said second bobbin path associated with the winding unit.

* * * * *